US005441389A

United States Patent [19]

Wolcott et al.

[11] Patent Number: 5,441,389

[45] Date of Patent: Aug. 15, 1995

[54] EDDY CURRENT DRIVE AND MOTOR CONTROL SYSTEM FOR OIL WELL PUMPING

[75] Inventors: John H. Wolcott, Racine; William L. Sieger, Franklin, both of Wis.; Alvin J. Watson, Ardmore, Okla.

[73] Assignee: Eaton Corporation, Cleveland, Ohio

[21] Appl. No.: 961,195

[22] Filed: Oct. 14, 1992

Related U.S. Application Data

[63] Continuation-in-part of Ser. No. 854,194, Mar. 20, 1992, abandoned.

[51] Int. Cl.[6] ..... F04B 49/00

[52] U.S. Cl. ..... 417/412; 417/18; 417/22; 417/24; 417/45; 417/223; 417/319; 417/420; 318/432

[58] Field of Search ..... 417/18, 22, 24, 42, 417/45, 53, 223, 319, 420; 310/95, 105, 103; 318/432, 739, 799

[56] References Cited

U.S. PATENT DOCUMENTS

| | | | |
|---|---|---|---|
| 3,518,472 | 6/1970 | O'Callaghan | 310/95 |
| 3,723,840 | 3/1973 | Opal et al. | 318/432 |
| 3,735,226 | 5/1973 | Pittner | 318/338 |
| 3,741,686 | 6/1973 | Smith | 417/240 |
| 4,040,508 | 8/1977 | Sunada et al. | 192/12 D |
| 4,390,321 | 6/1983 | Langlois et al. | 417/15 |
| 4,578,626 | 3/1986 | Richter | 318/338 |
| 4,971,522 | 11/1990 | Butlin | 417/18 |
| 4,997,346 | 3/1991 | Bohon | 417/319 |
| 5,114,315 | 5/1992 | Kaltenthaler et al. | 417/53 |
| 5,149,998 | 9/1992 | Wolcott | 310/105 |
| 5,204,595 | 4/1993 | Opal et al. | 318/430 |
| 5,355,060 | 10/1994 | Peterson | 318/432 |

*Primary Examiner*—Richard A. Bertsch
*Assistant Examiner*—Xuan M. Thai
*Attorney, Agent, or Firm*—Loren H. Uthoff, Jr.

[57] ABSTRACT

An eddy current coupling with an electrically controllable field current is used to rotatably connect a drive motor to an oil well pumping mechanism where the eddy current drive speed is controlled to a reference speed using a speed feedback control system and operation can be limited in torque output by a torque feedback control system. In a first alternative embodiment, the eddy current coupling output speed is controlled by a stroke modulation unit using a first selected speed for the upward pumping stroke and a second selected speed for the downward pumping stroke. In a second alternative embodiment a controller is used to select torque or speed control for the upward or downward .pumping stroke. An eddy current coupling output stall condition is sensed by comparing the eddy current drive speed to a preselected stall speed and when the eddy current coupling output speed dips below the stall speed limit, the eddy current coupling coil electrical power is disconnected thereby terminating the electromagnetic coupling of the eddy current inductor and pole member to disconnect the drive motor from the oil well pumping mechanism.

20 Claims, 6 Drawing Sheets

12'''

EDDY CURRENT DRIVE AND MOTOR CONTROL SYSTEM FOR OIL WELL PUMPING

This application is a continuation-in-part of applicants' application U.S. Ser. No. 07/854,194, filed Mar. 20, 1992, which application is now abandoned.

FIELD OF THE INVENTION

The present invention relates to the pumping of oil by sucker rod pumping, and more particularly to an oil well pumping system where the sucker rod is driven by an electric motor through an eddy current coupling where the motor is controlled by a speed and/or torque feedback loop providing for a variation in speed and/or torque depending on the direction of travel where a separate speed can be used for upward motion of the sucker rod and a second speed used for the downward travel of the sucker rod and an overload protection system and an overload protection system whereby the motor is disconnected from the eddy current coupling upon the sensing of an overload current.

DESCRIPTION OF THE PRIOR ART

Most artificial lift oil wells are produced by sucker rod pumping, most commonly with a beam pumping system which is driven by a high slip induction motor. In these systems, a surface prime mover such as the induction motor acts through a gear reduction system which powers the reciprocation of a sucker rod string. The sucker rod string is attached to a subsurface plunger that reciprocates downward and upward within a working barrel which is either intricately connected to the bottom of the well tubing or is intricately part of a subsurface pump assembly packed off against the tubing (or casing where tubing is not installed). The plunger has an aperture that is opened and closed by a travelling valve. In general, the column of oil rides in the tubing (or casing) is supported by the working barrel head when the travelling valve is opened and the standing valve is closed, and by the rod string plunger when the travelling valve is closed. An ordinary pump, at the start of the rod-drawn plunger stroke the travelling valve closes, and the fluid column load is picked up by the rods. As the plunger moves up, fluid in the pump chamber clearance space expands and pressure within the chamber decreases to the pump intake pressure at which time the standing valve opens, whereupon fluid from the producing zone of the well enters the pump chamber. As the rods and plunger continue their up stroke, the fluid column above the plunger is lifted essentially by the distance of up stroke travel, and the displaced volume of fluid essentially equal to the swept volume of the plunger in the working barrel is collected at the surface. During the up stroke, the pump chamber fills with producing fluids. On reaching the top of the up stroke and starting the down stroke, the standing valve closes and the travelling valve, under the weight of the undisplaced fluid column, remains closed. As the rods and plunger continue their down stroke, fluids within the chamber are displaced up through the travelling valve aperture into the tubing.

Because of the properties of the pumping action, it is desirable to vary the rate of the upward as compared to the downward stroke of the rod-drawn plunger for optimum production while minimizing the expenditure of energy necessary to power the beam pumping system. Specifically, it is desirable to decrease the rate of the downward stroke of the rod-drawn plunger as supported by a rod string and then to increase the rate on the upward stroke during which time the fluid of the well is being drawn upward towards the surface of the well to improve the oil production rate.

One pump situation which can be considered abnormal and introduces high loads into the mechanics of the oil well pumping system is what is known as "pump off" where the producing zone pressure is insufficient to cause complete liquid fillage of the pump chamber during the up stroke of the plunger and the travelling valve does not open on the ensuing down stroke until the plunger approaches and encounters the relatively incompressible liquid in the chamber. The resulting impact between the plunger and the liquid produces an upward force that is quite substantial in amplitude which causes a pounding that can be damaging to the rod string, the pump assembly and the surface pumping unit. Fluid pounding is caused by the pump piston accelerating in a downward direction through a gaseous space, whereupon the piston encounters the liquid phase with sufficient force that produces a shock wave having a magnitude dependent upon the quantity of gaseous products ingested into the pump barrel. The shock wave causes damage to the entire production apparatus and has been the subject of many different novel "pump off" control means as evidenced by the following patents, to which reference is made for further background of the invention.

U.S. Pat. Nos. 4,490,094, 4,661,751, and 4,631,954, the disclosures of which are hereby incorporated by reference.

The cited prior art discloses methods to monitor the loads encountered in the rod string where high load spikes indicate a condition of "pump off" whereupon the prime mover can be mechanically disconnected or the motor slip is increased to prevent damage due to excess mechanical loads.

Disclosed in the prior art are methods to vary speed of the induction type motor whereby the operator sets a desired speed which represents the compromise between oil production and mechanical forces encountered by the equipment. However, the conditions at the well head change over a period of time which invariably cause increased forces to be encountered and/or a condition such that the production rate of the well could be increased if the speed was adjusted accordingly. Variation in the well head can also result from such things as injection rates of water, $CO_2$ or steam floods. Thus, limitation with the prior art is the inability to adjust the rate of production as determined by the speed of the pumping apparatus as conditions within the well head change.

To increase production rates, it is desirable to slow the down stroke of the down hole pump attached to the sucker rod string to allow fulfilling of the cavity above the down hole pump and then using a fast up stroke to bring the oil to the surface thereby producing more fluid. This has the added benefit of providing better pump fillage by using a slow down stroke and decreasing the tendency to encounter gaseous products under the piston pump. Also, the slow down stroke lessens the shock load on the pump equipment by easing the plunger pump through any incomplete pump fillage.

In addition, a system that can vary the speed of the sucker rod at anytime during the upward or downward stroke could increase production (with a reduced likelihood of pump-off) since control of speed allows for more complete fillage of oil above the pump plunger. The prior art provides no such directional speed control capability and thus, compromises must be made between energy consumption, oil production, and equipment loads induced by pumping abnormalities.

Another limitation of the prior art is the inability to minimize power consumption by starting the motor prime mover in a no load condition so that the start up amperage is minimized. It is common to design electric drive motors which are to be utilized in well pumps with a high amount of slip capability. This slip is the amount of slip from synchronous motor speed that occurs as the motor attempts to overcome the weight of the fluid column on top of the pump at the beginning of case stroke. This slip generates high currents and heat. Additionally, the high current peaks generated during such slip operation and the fact that the motor is substantially unloaded during each downstroke causes a poor power factor and an attendant increase in operating costs.

Prior art well pumping systems have no means of disconnecting the prime mover from the pumping apparatus upon torque overload where the drive is stalled and the drive motor continues to supply full power to the well head pumping system thereby causing mechanical damage. Preset constant speed pumps have severe problems with pump rod stress due to the inability to control drive torque and consequently frequent rod breakage occurs. The most common drive system is a simple constant speed motor. These motors utilize some form of "high slip" design as discussed supra which tend to reduce the torque peaks where the amount of drive torque reduction available is the function of the selected motor's characteristics. To minimize the loads introduced into the oil well pumping system and to maximize production while minimizing input energy, it would be desirable to control both speed and torque of the drive system in all phases of the pump stroke. The pump that pumps too slowly is not efficient and one that pumps at too high a rate is in danger of "pumping off" which is an industry term for momentarily pumping the well dry. A variable pumping rate that matches conditions is obviously desirable.

SUMMARY OF THE INVENTION

The present invention provides for a method of preselecting a sucker rod speed for the upward stroke and selecting a second sucker rod speed for the downward stroke to increase oil well production while minimizing electrical energy and likelihood of well "pump off". The operator preselects two speeds, one to be used on the pump up stroke and a second to be used on the pump down stroke so that efficient filling of the pumping unit with oil occurs while moving the oil to be raised to the surface at maximum speed for increased production.

The preferred type of coupling used in the present invention is one of the type known as an eddy current coupling as disclosed in U.S. Pat. No. 4,780,637, the disclosure of which is hereby incorporated by reference. This type of coupling allows a less expensive lower slip induction type drive motor to be used to drive the pump mechanism. The speed and torque regulation takes place by control of the field coils in the eddy current coupling where the torque transferred from the rotor side of the coupling to the stator side of the coupling is set by the amount of current that flows into these coils. By using the coupling control system of the present invention, the current level of the eddy current coupling coils can be accurately controlled so as to control the speed of the output of the coupling and the maximum torque transferred into the oil weal pumping mechanism.

To increase the efficiency and reliability of walking beam oil pump by taking advantage of the operational characteristics of an eddy current drive which provides for coupling of the drive motor to the pump mechanism with an electromagnetic field produced by an electrical coil which couples the rotor to a stator and allows relative motion at variable slip rates as determined by the electronic control of the coil energization. By properly controlling the coupling coil higher efficiency can result in more oil pumped for the same electrical power usage and cost or in the alternative the same amount of oil production can be attained with a reduced energy cost. By limiting the torque output of the coupling device with a torque feedback control and also monitoring the output speed so that the coupling can be used to disengage the drive motor from a pumping mechanism upon a pump stall condition, higher reliability can be attained through proper maintenance which results in a lower percentage of non-productive down time and less frequent replacement of expensive pump components. This allows for free motion between the eddy current drive rotor in the stator thereby effectively disengaging the drive motor from the pump mechanism and preventing damage to the equipment. If the speed drops below the adjustable predetermined level for a fixed period of time, the control system will disengage the eddy current coupling and indicate that the stall condition has occurred to maintenance personnel so that corrections can be taken.

The speed and torque of the eddy current coupling is continuously monitored and controlled by a coupling control system which also permits the upward and downward stroke speed of the pump to be varied to further increase production. Automatic remote control is also possible by using a central supervisory controller to provide input to each of the well coupling control systems.

Another advantage of the eddy current coupling is in the ability to change the pumping rate of the well by simply changing a potentiometer setting or modifying the speed reference input voltage to the coupling control system. No other simple rod pump drive system is known to be capable of selecting the speed of the drive as the rod string is lowered and a separate faster speed as it is pulled up or visa versa. Two advantages are claimed for the two-speed pumping cycle, higher production because of ideal pump speed while filling and while ejecting and the second advantage being reduced stretch on the rod which results in a slower fatigue rate and therefore, longer periods between replacement.

A stroke control module allows an operator to provide two or more speed set points to control speed in specific portion of the pump stroke. Typically the selection would be for two different speed settings, one being for the down stroke of the rod string and a second for the up stroke portion of the rod string. This feature is called Intrastroke Modulation. In the preferred embodiment, this feature includes proximity sensors adjustably mounted on the pump jack head unit to sense position and trigger the proper preselected speed set point. More than two proximity sensors could be used but two is the preferred mode of the invention. Provisions are also made for accepting an external speed reference which could bypass the onboard speed set points where the external speed reference signal would originate from a central controller or from a second smart controller at the well head. Such a smart controller would sense conditions at the well that would require a speed change to prevent damage to the well components or to increase the rate of production. A typical damage situation would be a "pump off" condition recognized through some type of signature analysis as disclosed in U.S. Pat. No. 4,509,901, the disclosure of which is hereby incorporated by reference, that would sense the onset of pump off and at that point decrease the rate of pumping by lowering the speed before serious damage to the pump components occurs.

Another provision of the present invention is the speed and torque control of the output of a coupling such as an eddy current coupling that drivingly connects the drive motor and the pump mechanism which is connected to the walking beam pump assembly. By using both a speed and torque control feedback loop on the coupling, the maximum torque into the pump mechanism can be controlled to prevent mechanical damage and to increase well efficiency.

Another provision of the present invention is to increase the overall efficiency of the oil producing well by minimizing the electrical energy that must be supplied to the drive system by allowing separate speeds to be used for the pump up stroke and the pump down stroke.

Another provision of the present invention is to provide both speed and torque control to a coupling preferably of the eddy current type so that maximum loads are accurately controlled into the pumping mechanical assembly thereby preventing damage.

Another provision of the present invention is to provide sensing of a stall condition where, when the speed of the output shaft coupling falls below a predetermined minimum speed for a given amount of time, the electrical connection between the power amplifier used to supply electrical current to the eddy current coupling coils can be disconnected by operation of a solid state switch thereby preventing damage to the well pumping assembly.

Another provision of the present invention is to provide for a torque limit control where the speed feedback can control regulation is overridden allowing the speed to decrease to limit the torque to a maximum preset value so that forces into the pump mechanism are controlled to prevent failures. Also, motor current peaks can be controlled in this fashion and since power companies base their rate on peak draw and power factor, a decrease in overall energy cost can be realized at the expense of overall stroke rate.

Another provision of the present invention is to detect a stall condition where some abnormality has occurred in the pump mechanism thereby slowing the speed below a predetermined minimum whereupon a speed monitor detects the condition and opens the electrical circuit between the coupling control system which provides power to the coupling coil in the coil itself.

Another provision of the present invention is a combination of the intrastroke modulation feature combined with the torque limit control at all parts of the pump stroke.

Another provision of the present invention is to provide for separate speeds for the upward and downward stroke of the sucker rod using torque feedback and/or speed feedback.

Another provision of the present invention is to provide for torque control using a maximum speed limit to keep the unit for overspeeding in case of gas or steam or lighter fluids entering the pump.

Another provision of the present invention is to provide for constant torque output from the eddy current coupling into the pump mechanism.

Still another provision of the present invention is to provide for a speed reduction when well pump-off condition is detected to prevent damage to the well components.

DETAILED DESCRIPTION OF THE PREFERRED EMBODIMENT

Figure 1:
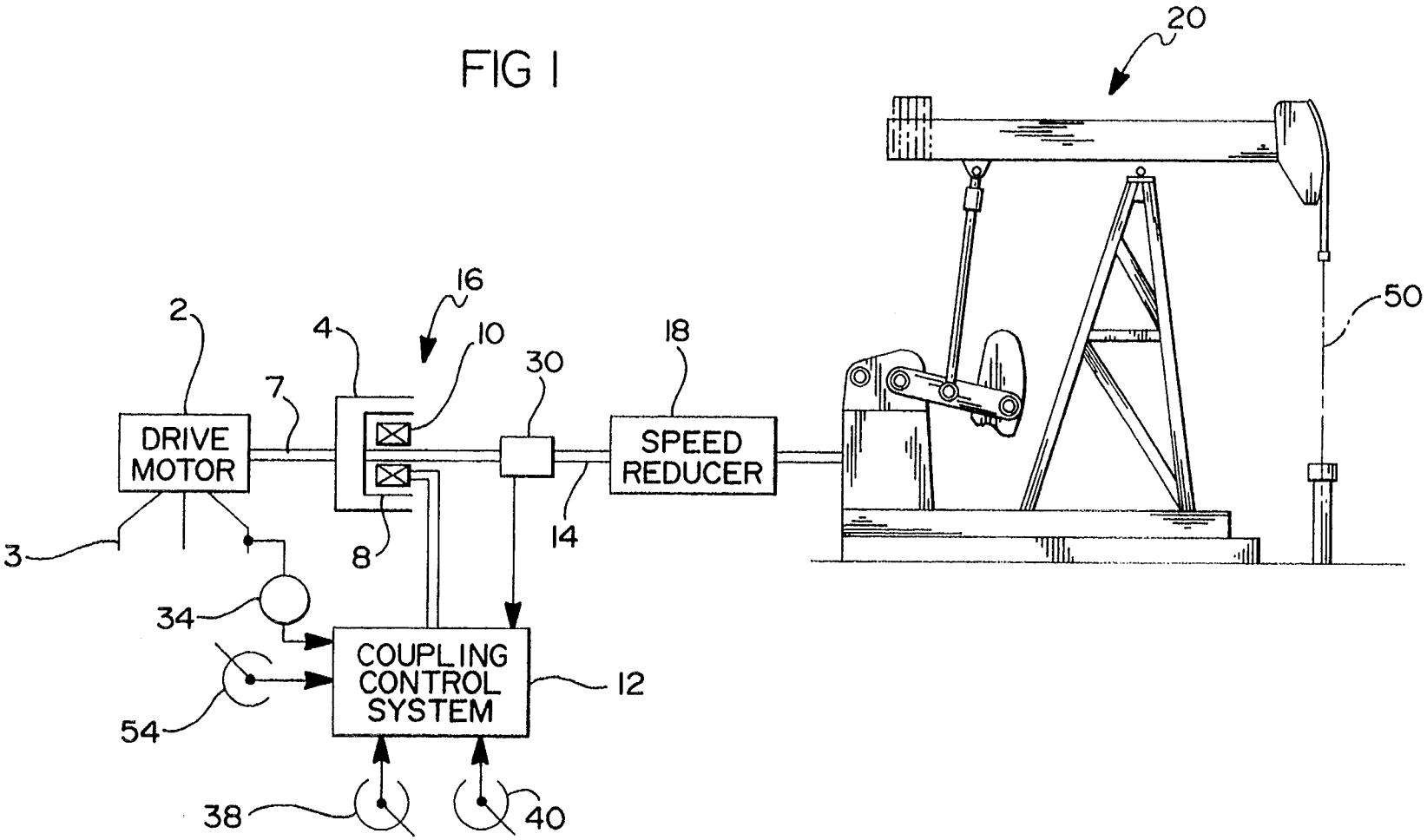
FIG. 1 is a block diagram of the present invention connected to an eddy current coupling which connects a drive motor to a drive mechanism which powers a walking beam oil pump.

Referring to FIG. 1 an electrical drive motor 2 powered, by an electrical source 3 is shown nonrotatably connected to the induction drum 4 of an eddy current drive coupling 16 which electromagnetically couples the inductor drum 4 to a pole member 8 by supplying an electrical current to a coil 10. The eddy curve coupling 16 is controlled by the electrical power supplied to the coil 10 by the coupling control system 12 which determines the amount of torque that is transferred between the inductor drum 4 and the coupling pole member 8 to the coupling 14. Consequently, depending on the pump load, the electric power to the coil 10 also controls the relative speed (commonly celled "slip speed") between me inductor drum end the pole member 8.

The coupling control system 12 can accept several input signals such as those from reference speed sources and proximity switches and includes processing and logic capabilities so that decisions can be made on the character of the output signals such as the power signal to the eddy current coupling 16. The coupling output 14 is nonrotatably connected to an oil pump mechanism 20 by way of a speed reducing mechanism 18 which transports subsurface oil to the surface for containment.

Figure 2:
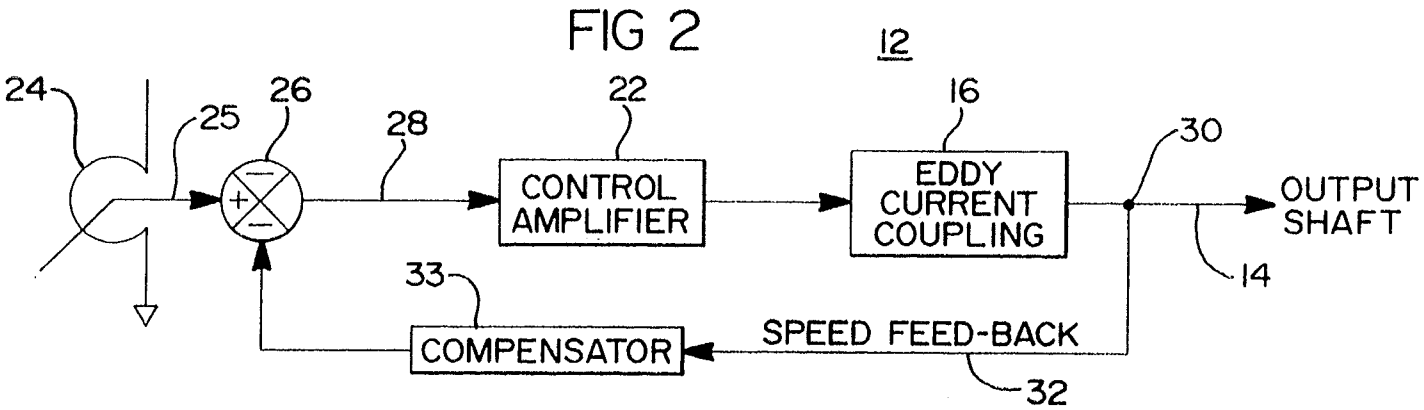
FIG. 2 is a block diagram of a basic eddy current coupling control system using speed feedback.

Referring to FIG. 2, a coupling control system 12 is shown which is used on a well pumping system consisting of a drive motor such as an electrical drive motor 2 whose output shaft is mated to an input shaft 7 of an eddy current coupling 16 having a coupling output 14 which leads to the pumping mechanism 20 such as a beam pumping unit which can utilize some type of gear reduction before linking with the beam which directly controls the motion of a cable arrangement known in the a as a sucker rod 50 that connects with a downhole pump. The eddy current coupling 16 is of the type whose function is to electromagnetically couple an inductor drum 4 with a pole member 8 where the electromagnetic linkage is established by the output of a control amplifier 22 to a coupling coil 10. Generally, the speed of the input to the eddy current coupling 16 is greater than the speed of the coupling output 14 where the speed differential depends on the load experienced by the coupling output 14 and the electrical input to the coupling coil 10 as determined by the output of the control amplifier 22. A detailed explanation of the construction and operation of a brushless eddy current coupling is disclosed in U.S. Pat. No. 4,780,637.

Again referring to FIG. 2, a coupling control system 12 is shown which provides a basic speed control for the eddy current coupling 16 where a speed reference 24 is set at a value of the desired output speed for the coupling output 14 where the output signal of the speed reference 24 is connected to a summing junction 26 whose output is input control signal 28 which is supplied as an input to the control amplifier 22. As discussed supra, the output of control amplifier 22 is the electrical power which controls the electromagnetic coupling and the resulting torque transfer level of the eddy current coupling 16 whose coupling output 14 is a rotating shaft. The speed of the coupling output 14 is measured by a speed sensor 30 whose output produces a feedback signal 32 which is mathematically manipulated by a control compensator 33 and then routed to the summing junction 26 and is subtracted from the signal to summing junction 26 from the speed reference 24. In this manner, the speed of the coupling output 14 is controlled using feedback techniques so that its speed is controlled to the desired speed as set by the speed reference 24.

Figure 3:
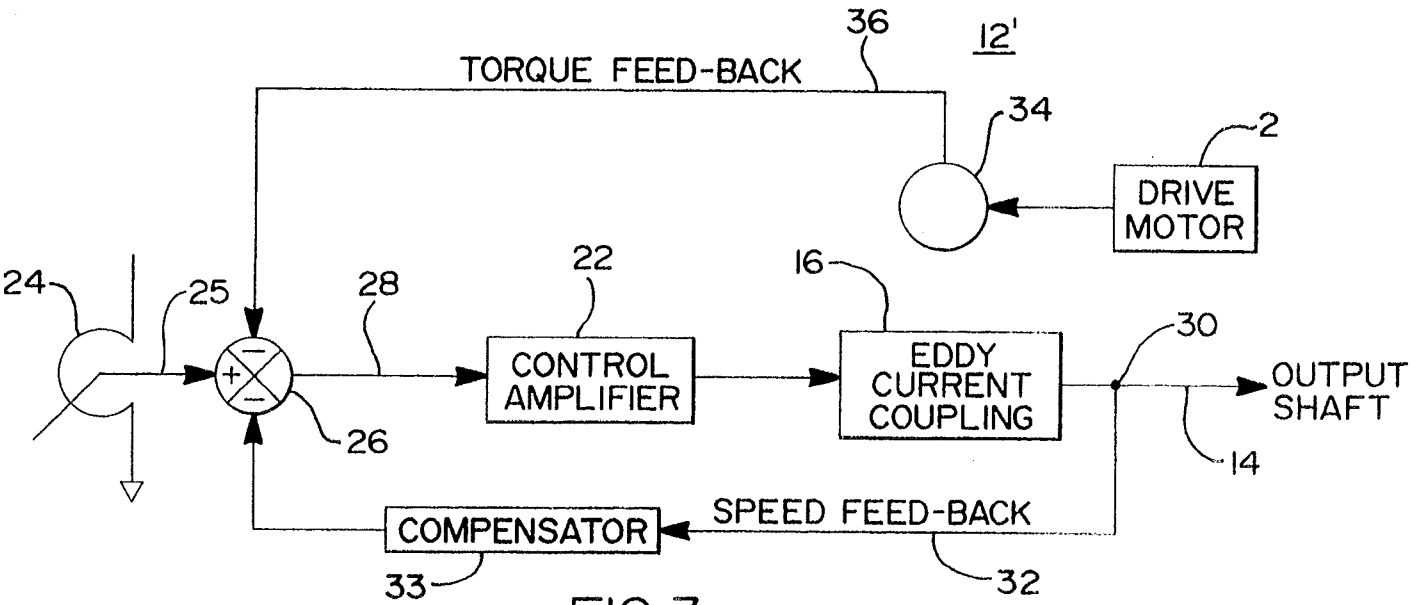
FIG. 3 is a block diagram of the present invention as shown in FIG. 2 with a second feedback loop utilizing torque feedback.

Now referring to FIG. 3, a coupling control system 12 is shown which is used to control the electromagnetic coupling of the eddy current coupling 16 where a coupling torque limiter 34 has been added to the control system 12 as shown in FIG. 1. The coupling torque is proportional to the electrical signal supplied by the control amplifier 22 to the coil 10 of the eddy current coupling 16. The torque limiter 34 is passive unless the current to the drive motor 2, whose amplitude is sensed and sent to torque limiter 34, exceeds a preset limit whereupon, the coupling torque limiter 34 outputs a torque feedback voltage 36 which is routed as an input to the summing junction 26 and is subtracted from the output voltage of speed reference 24. In this manner, the coupling output 14 is limited in its maximum torque thereby preventing damage to the pumping mechanism 20.

Figure 4:
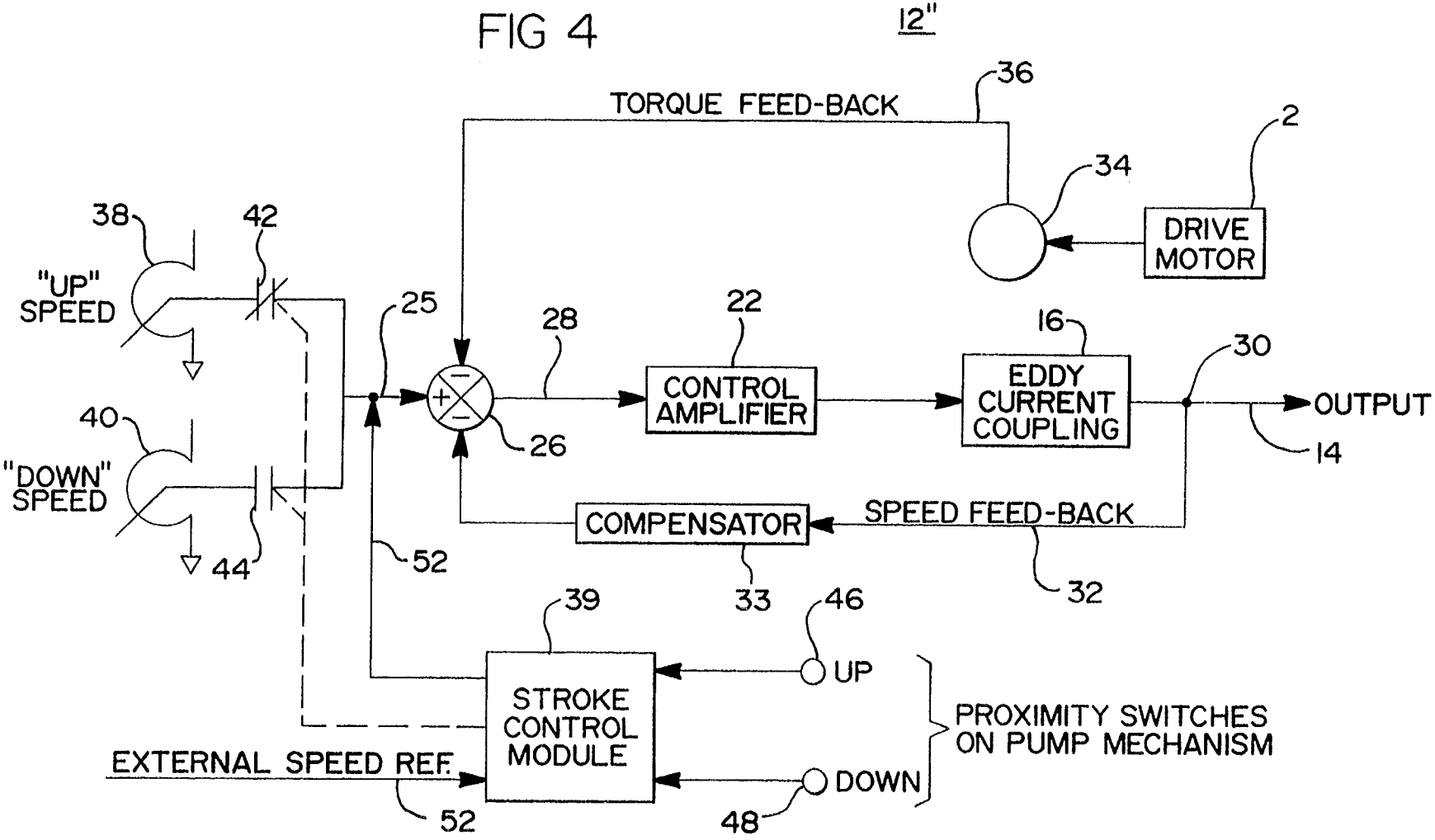
FIG. 4 is a block diagram of the present invention as shown in FIG. 3 with an addition of an intrastroke modulation speed control module.

Now referring to FIG. 4, an alternate embodiment of the basic coupling control illustrated in FIG. 2 and the coupling control system 12' with torque limit as illustrated in FIG. 3 is shown. FIG. 4 is a block diagram showing the coupling control system 12 with a torque limiter 34 and a stroke speed control module 39 where the speed of the coupling output 14 of the eddy current coupling 16 is regulated to the speed reference 25 through the use of a speed feedback signal 32 which is mathematically manipulated in the speed control compensator 33 and routed to summing junction 26. The torque of the coupling output 14 is limited through the use of a coupling torque limiter 34 where a torque feedback voltage 36 is produced and fed to the summing junction 26 when the current to the drive motor 2 exceeds a set value. A stroke speed control module 39 is then added to the control circuit to implement the feature of providing a first independent speed for upward travel of the rod string 50 and a second independent speed for downward travel of the rod string 50 for increased oil well production, the operation of which is described infra.

A desired speed for upward motion of the rod string 50 is set by the up speed reference 38 and a desired downward speed of the rod string 50 is set by down speed reference 40 where the two values are exclusive preselected speed signal inputs to the summing junction 26 and either the up speed reference 38 is selected as an input to summing junction 26 by the closure of the up reference switch 42 and the opening of the down reference switch 44 or the down speed reference 40 is selected as an input to summing junction 26 with the closure of the down reference switch 44 and the opening of the up reference switch 42. The state of the up reference switch 42 and the down reference switch 44 are controlled by a stroke speed control module 39 where the stroke speed control module 39 internal logic determines whether to close or open the reference switches 42 and 44 based on, among other parameters, inputs from an up stroke switch 46 and a down stroke switch 48 which can be proximity switches such as a Hall Effect sensor mounted on the pump mechanism 20. The control module 39 can consist of a microprocessor unit having an analog-to-digital converter with the control logic contained therein. The state of the stroke switches 46 and 48 indicate the direction of travel of the pump rod string 50 (see FIG. 1) so that the stroke speed control module 39 is able to discern the operational state of the pump mechanism 20 and close or open the reference switches 42 and 44 to supply the proper reference speed to summing junction 26 to control the speed of the coupling output 14 and the pump mechanism 20 for improved efficiency or to prevent damage.

As an additional control option an external speed reference 52 can be selected to be sent to summing junction 26 by the stroke speed control module 39 which sets the speed of the coupling output 14 when desired and neither the up reference switch 42 or the down reference switch 44 are closed by the stroke control module 39. The external speed reference 52 can be generated by a "smart" controller at the well site which can measure a variety of well site parameters such as individual well pumping conditions and generate an appropriate external speed reference 52 signal to improve production or prevent pump damage.

Figure 5:
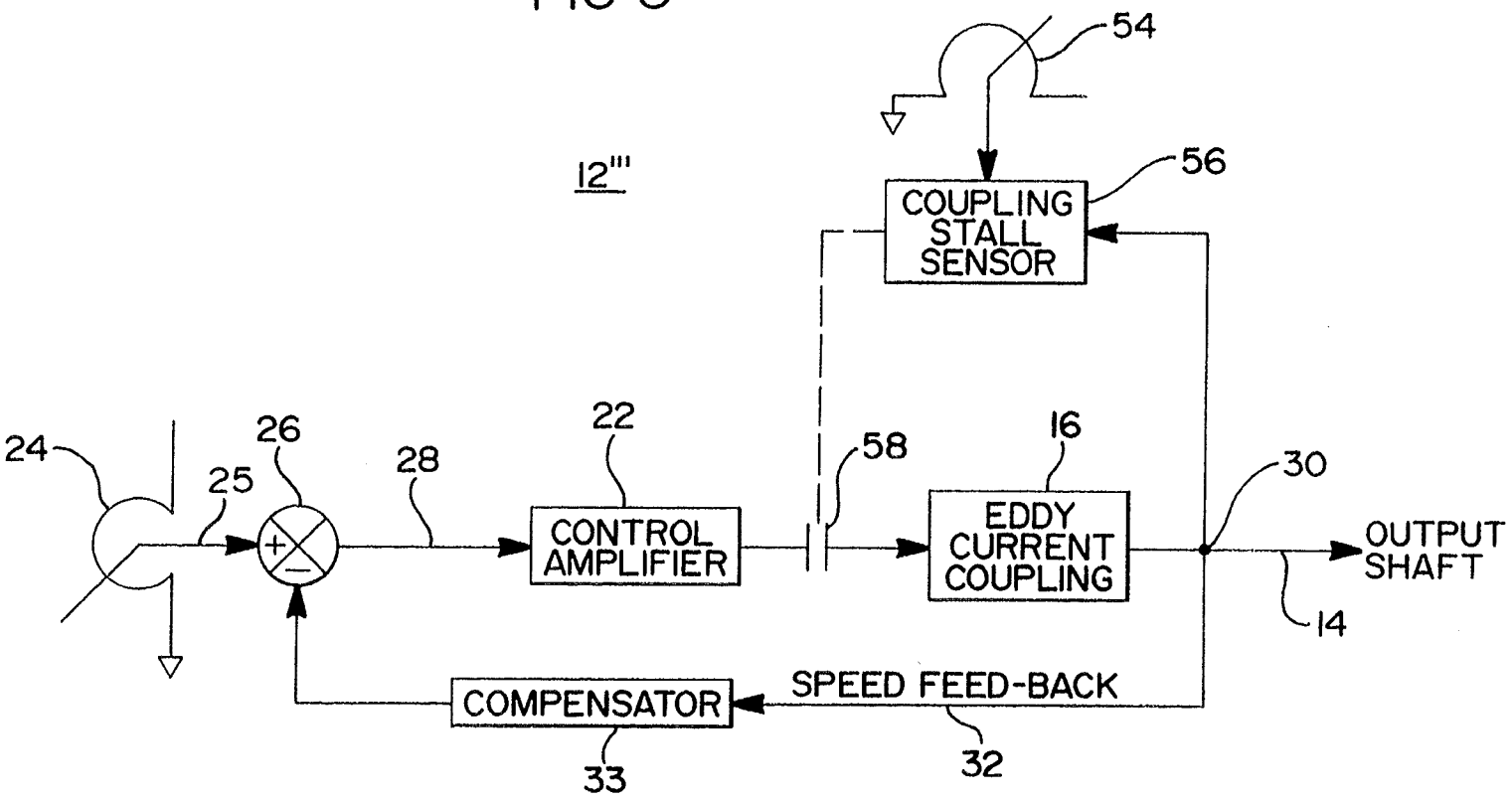
FIG. 5 is a block diagram of the present invention as shown in FIG. 1 with the addition of a stall speed sensor.

Now referring to FIG. 5, a modification of the basic speed control is shown so as to provide for the disconnection of the control amplifier 22 output electrical signal to the eddy current coupling 16 upon the sensing of a pump stall condition which can cause overloads and damage and occurs when the speed of the coupling output 14 falls below a selected stall speed reference 54. A coupling stall sensor 56 controls a coupling stall switch 58 which opens and disconnects the output of the control amplifier 22 from the eddy current coupling 16 thereby effectively disconnecting the drive motor 2 from the pumping mechanism 20. In this manner, upon occurrence of a damaging abnormal situation such as a "pump off" condition, the high loads experienced by the rod string 50 are limited by sensing the overload stall condition and disconnecting the drive motor 2 from the pumping mechanism 20. In the alternative, the input current to the drive motor 2 could be reduced or eliminated.

Figure 6:
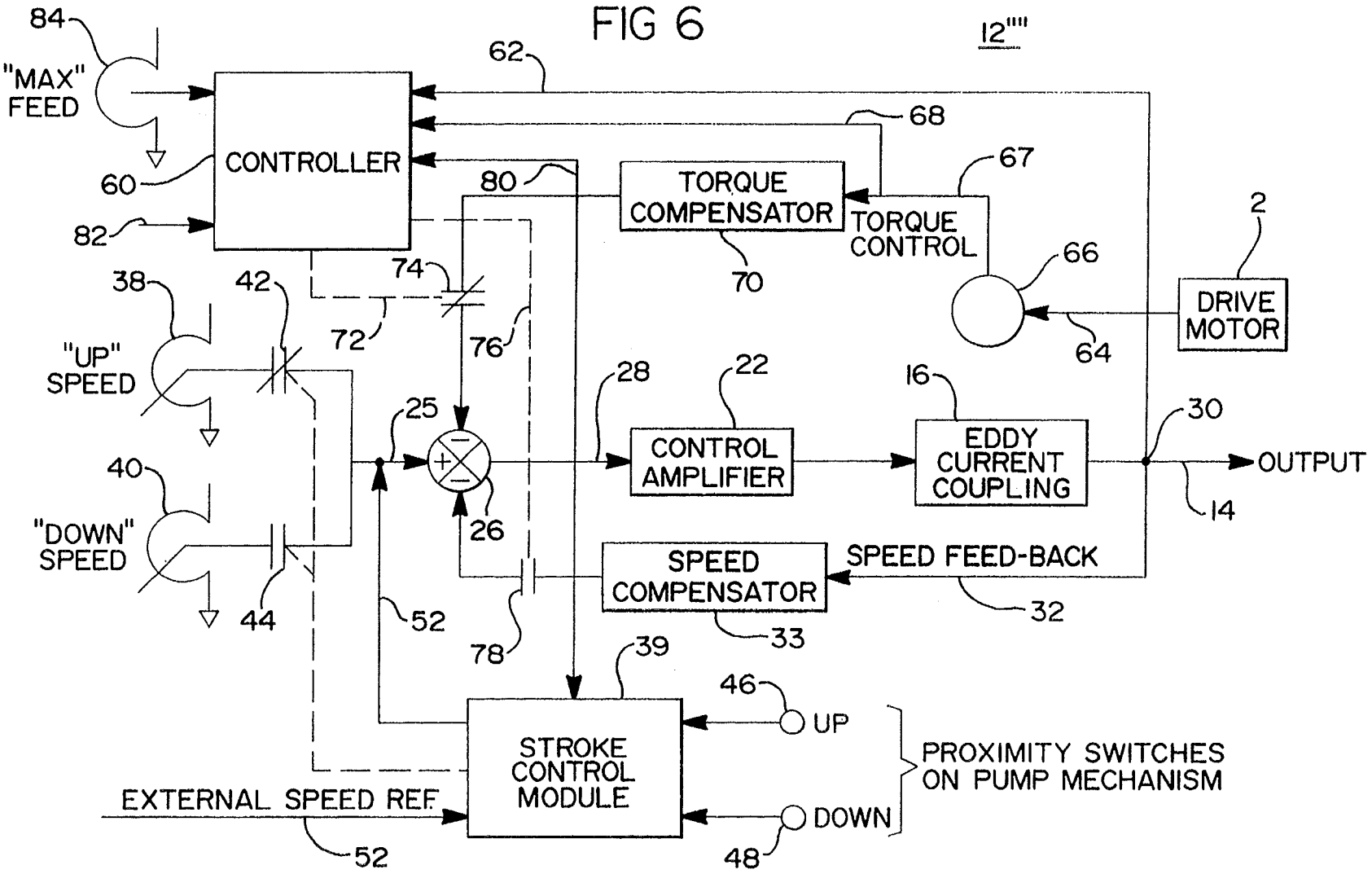
FIG. 6 is a block diagram of the present invention showing the use of torque control and/or speed control and selected speeds for upward and downward pump travel.

Now referring to FIG. 6, a coupling control system 12''' is shown which is used on a well pumping system consisting of a drive motor 2 whose output shaft is connected to an input shaft of an eddy current coupling 16 having an output shaft 14 which leads to the pumping mechanism 20 which is not shown. A stroke speed control module 39 is connected to an up speed reference: to the desired speed when the sucker rod is moving in an upward direction and is connected to the summing junction 26 through the up reference switch 32. In a like manner, the down speed reference 40 is the desired speed of the sucker rod travel when moving in a downward direction and is connected to the summing junction 26 through the down reference switch 44. The up reference switch 42 and the down reference switch 44 are controlled by the stroke control module 39 where when one switch is open the other is closed. An up stroke switch 46 is mounted on the pumping mechanism 20 and indicates when the sucker rod,is moving in an upward direction and likewise a down stroke switch 48 is mounted on the pumping mechanism 20 and indicates when the sucker rod is moving in a downward direction where both of the signals are communicated to the stroke control module 39. In addition to the up speed reference 38, the down speed reference 40, and an external speed reference 52 can be supplied to the stroke control module 39 where the stroke control module 39 selects which speed reference signal should be used to most effectively control the coupling control system 12'''.

In one mode, the stroke control module 39 closes the up reference switch 42 and opens the down reference switch 44 while supplying no signal to the external speed reference line 52 when the up speed reference 38 is desired. When the down speed reference 40 is to be used to control the coupling control system 12''', the down reference switch 44 is closed and the up reference switch 42 is open and no signal is supplied on the external speed reference 52 by the stroke control module 39. If it is desired to use the external speed reference 52, the up reference switch 42 is opened and the down reference switch 44 is opened and the external speed reference 52 is connected to the summing junction 26 through action of the stroke control module 39.

A controller 60 is used to perform a variety of tasks including control of the stroke control module 39,the state of a plurality of switches based on several inputs. The speed feedback 32 is inputted to the controller 60 by way of output speed line 62. The drive motor 2 is powered by electrical current which is measured by the current sensor 66 which uses the input electrical current to calculate the output torque of the drive motor 2 which is connected to a torque compensator 70 and the controller 60 through the motor torque signal lines 67 and 68. The output of the torque compensator 70 is routed into a torque feedback switch 74 whose state is controlled by the switch control line 72 and by the controller 60 where if the torque feedback switch 74 is closed the torque feedback signal flows into the summing junction 26 and provides for control of the eddy current coupling 16 through a drive motor torque feedback system.

The controller 60 is also electrically connected to the stroke control module 39 by way of a communication line 80 where the controller can both send and receive the signals from the stroke control module 39 and can control operation of all of the switches whose state is controlled by the stroke control module 39 such as the up reference switch 42, the down reference switch 44, and the selection of the external speed reference 52.

The controller 60 also controls the state of the speed feedback switch 78 which operates when in a closed state to connect the output of the speed feedback compensator 33 to the summing junction 26 for use in a speed feedback control system of the eddy current coupling. An output signal from an external electronics package can be connected to the controller by way of external line 82 which can be of a type indicating a pump-off condition in the well using an external pump-off or other abnormal operation sensing system or a signal from a central control system that communicates with a multiplicity of wells in the field.

The maximum allowable speed of the pumping mechanism 20 is set by way of a maximum speed signal 84 which is connected to the controller 60. By monitoring the output speed of the eddy current coupling through the speed sensor 30, the controller 60 can modify the input control signal 28 to limit the speed of the output of the eddy current coupling 16.

With this type of arrangement, a separate speed for upward travel of the sucker rod and a separate speed for the downward travel of the sucker rod can be selected for use with both a torque control and/or a speed control coupling control system 12''' where the maximum speed of the pumping mechanism 20 is limited by the maximum speed setting 84. With this type of system, it is possible to close the torque feedback switch 74 and open the speed feedback switch 78 when the sucker rod is moving upward and then open the torque feedback switch 74 and close the speed feedback switch 78 when the sucker rod is moved downward or vice versa.

Also, the torque of the input to the eddy current coupling 16 by the drive motor 2 can be controlled by way of the controller 60 through measurement of the input current to the drive motor which represents the torque output of the drive motor 2 where the torque is calculated and fed to a compensator,.for use as a feedback signal into the summing junction 26 which controls operation of the eddy current coupling 16 such that a high torque control signal would subtract from the input to the summing junction 26 thereby limiting the torque of the coupling output 14. Also, the controller 60 monitors the speed of the coupling output 14 by the speed sensor 30 so that a maximum speed 84 can be set to limit the speed of the coupling output 14. Similarly, the speed of the coupling output 14 can be controlled to a desired value whether from the up speed reference 38 or the down speed reference 40 or the external speed reference 52 or from an external signal on the external line 82 by closing the speed feedback switch 78 and using the controller 60 to signal the stroke control module 39 to select the appropriate speed reference signal. All electrical elements can be physically contained within the controller.

Figure 7:
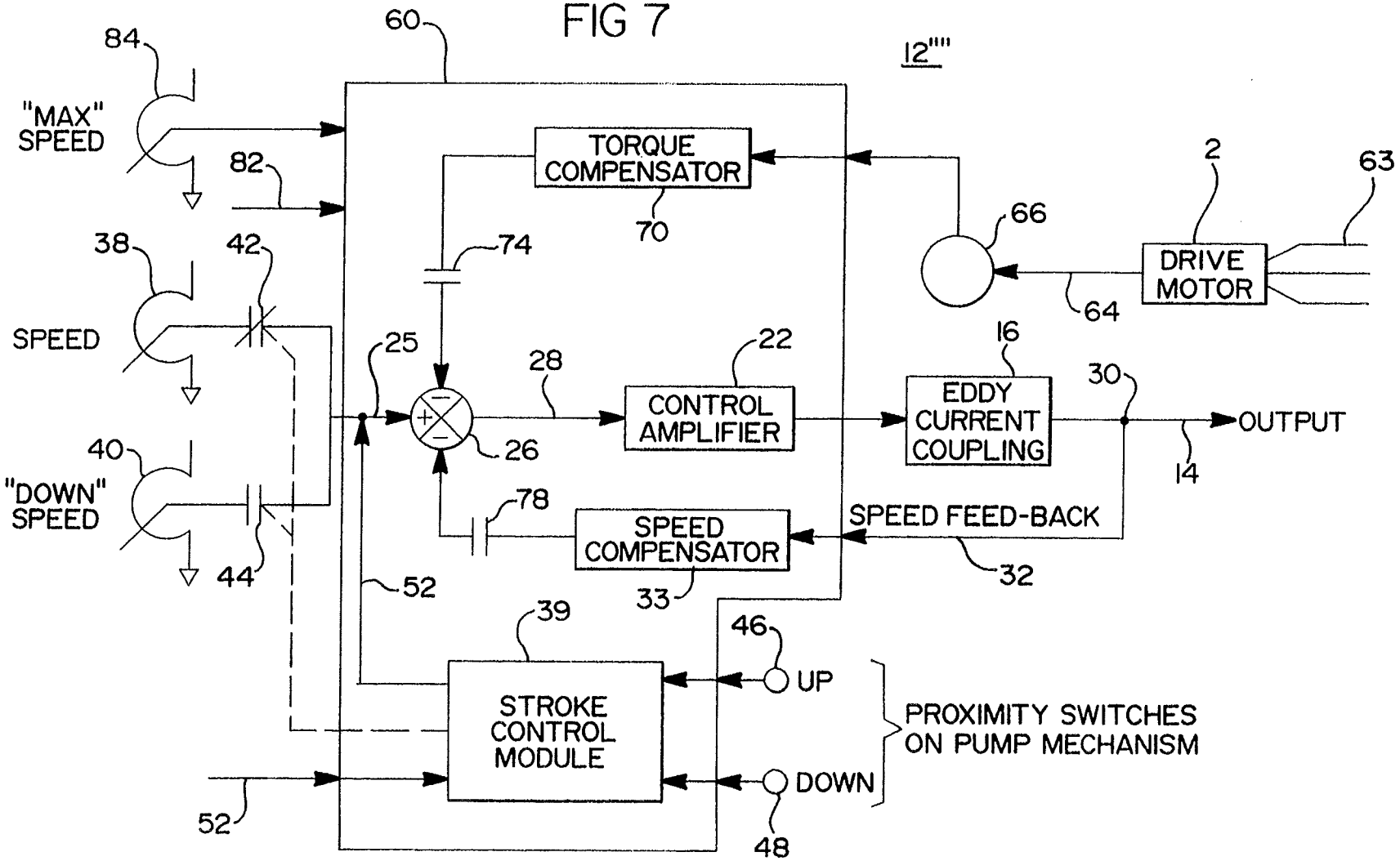
FIG. 7 is a block diagram of the present invention illustrating the packaging of the various control elements in one package.

FIG. 7 shows an alternate embodiment coupling control system 12''' where the controller 60 contains the torque compensator 70, the control amplifier 22, the speed compensator 33, the summing junction 26, the torque feedback switch 74, the speed feedback switch 78 and the stroke control module 39. The controller 60 can contain more of the elements than those shown in FIG. 7 depending on the electronics required and the physical constraints. The speed references 38, 40 and 84 can also be contained in the controller 60. Also, some of the elements shown within the controller 60 can be located outside the controller 60 such as the stroke control module 39.

The current sensor 66 can be a coil of wire which is wound around an iron core which surrounds a power lead 63 which supplies electrical current to the drive motor 2. The measured current is then conducted to the torque compensator 70 where it is mathematically manipulated to represent the motor 2 output torque and to properly control the eddy current coupling 16.

The description above refers to a particular embodiment of the present invention, will be understood many modifications may be made without departing from the spirit thereof. Accompanying claims are intended to cover such modifications as that falls into the scope and spirit of the present invention.

For the sake of simplicity, a number of above described incidental or peripheral circuit elements are not described in detail herein, it being understood that such functions are well understood by those of ordinary skill in the art and that suitable componentry is commercially available.

What is claimed is:

1. An eddy current coupling control system for an oil well pump comprising: an oil well drive system for moving a sucker rod upward and downward; an AC electric drive motor for powering said oil well drive system;

an eddy current coupling assembly comprising a driven rotatable input shaft coupled to said AC electric drive motor, a rotatable output shaft connected to said oil well drive system where said input shaft is electromagnetically coupled to said output shaft by an inductor drum which surrounds a peripheral surface of a pole member, where a coil means induces an electromagnetic flux that travels through said inductor drum and said pole member for electromagnetically coupling said inductor drum to said pole member;

speed sensing means for generating a speed signal representing the rotational speed of said output shaft of said eddy current coupling;

control means for supplying electrical power to said coil means;

motor torque sensing means for generating a torque signal representing the output torque of said AC electric drive motor;

direction sensing means for generating a direction signal indicating the downward travel and upward travel of said sucker rod;

speed select means for generating a speed select signal representing the desired operating speed of said oil well drive system;

summing junction means for adding and subtracting a plurality of input signals; and control logic means connected to said speed sensor means and connected to said control means and connected to said motor torque sensing means and connected to said direction sensing means where said control logic means connects and disconnects said speed signal from said summing junction means and connects and disconnects said torque signal from said summing junction means and connects and disconnects said speed signal to said summing junction means and connects and disconnects said up speed select signal from said summing junction means to maximize the production from said oil well pump.

2. The eddy current coupling control system of claim 1, wherein said control logic means comprises a microprocessor unit with an analog-to-digital converter and a control logic program contained therein.

3. The eddy current coupling control system of claim 1, wherein said speed select means generates a down speed select signal representing the desired travel speed of said oil well pump when moving in a downward direction and an up speed select signal representing the desired travel speed of said oil well pump when moving in an upward direction.

4. The eddy current coupling control system of claim 2, wherein said control logic means connects said up speed select signal to said summing junction when said oil pumping means is moving in an upward direction and connects said down speed select signal to said summing junction when said oil pumping means is moving in a downward direction.

5. The eddy current coupling control system of claim 1, further comprising a well pump-off detector means for generating a pump-off signal when said oil well pumping means is experiencing an abnormal pumping cycle where said pump-off signal is transmitted to said control logic means.

6. The eddy current coupling control system of claim 5, further comprising an external speed signal representing a desired operating speed of said oil well pump, where said control logic means connects said external speed signal to said summing junction when said pump-off signal indicates an abnormal oil well pumping cycle.

7. The eddy current coupling control system of claim 1, wherein said control means connects said motor torque sensing means to a torque compensator and then to said summing junction means.

8. The eddy current coupling control system of claim 1, wherein said control means connects said speed signal to a speed compensator and then to said summing junction.

9. The eddy current coupling control system of claim 1, wherein said motor torque sensing means comprises a current sensing means for measuring an input electrical current to said AC electric drive motor and a calculation means for generating said torque signal based on said input electrical current.

10. An eddy current coupling control system for an oil well drive comprising:

an AC electric drive motor for powering an oil well pump;

an eddy current coupling assembly comprising a driven rotatable input shaft coupled to said AC electric drive motor, a driven rotatable output shaft, an inductor drum surrounding a peripheral surface of a pole member, said inductor drum being rotatable relative to said pole member, a coil means for inducing an electromagnetic flux for coupling said inductor drum and said pole member and said input shaft and said output shaft;

oil well pumping means nonrotatably connected to said output shaft of said eddy current coupling for moving a sucker rod upward and downward;

speed sensor means for generating a speed signal representing the rotational speed of said output shaft of said eddy current coupling;

control means for supplying electrical power to said coil means for coupling said inductor drum and said pole member in response to said input control signal;

a down speed signal means for generating a first speed signal representing the desired travel speed of said sucker rod in the downward direction;

an up speed signal means for generating a second speed signal representing the desired travel speed of said sucker rod in the upward direction;

direction sensor means for generating a direction signal indicating when said sucker rod is travelling in a downward direction and when said sucker rod is travelling in an upward direction; and a second control means for establishing a control signal in dependence on said first speed signal when said sucker rod is travelling downward and establishing a control signal in dependence on said second speed signal when said sucker rod is travelling upward as indicated by said direction sensor means where said control signal is connected to said electric drive motor for improving the production rate of said oil well pump by selecting an operating speed for said oil well pumping means when said sucker rod is travelling downward and another speed for said oil well pumping means when said sucker rod is travelling upward.

11. The eddy current coupling control system of claim 10, wherein said direction sensor means is a proximity switch.

12. The eddy current coupling control system of claim 10, wherein said direction sensor means is of the type known as a Hall Effect sensor.

13. The eddy current coupling control system of claim 10, wherein said a second control means establishes said control signal by subtracting said speed signal from said first speed signal and by subtracting said speed signal from said second speed signal.

14. The eddy current coupling control system of claim 10, further comprising:

logic means within said means control means for calculating said control signal in dependence on said speed signal and said direction signal.

15. The eddy current coupling control system of claim 10, wherein said speed signal is generated by an external source.

16. The eddy current coupling control system of claim 10, further comprising:

speed switching means with the state of said speed switching means controlled by said pump direction sensor and where said speed switching means connects said first speed signal to said second control means when said direction sensor indicates that said oil well pump is moving in a downward direction and where said speed switching means connects said second speed signal to said second control means when said direction sensor indicates that said oil well pump is moving in an upward direction.

17. A method of controlling an eddy current drive coupling for use on an oil well pump comprising:

providing an AC electric drive motor;

providing an eddy current coupling comprising a driven rotatable input shaft electromagnetically rotatably coupled through an inductor member and a pole member where an electromagnetic field is generated by a coil means which travels through said inductor member and said pole member to a driving rotatable output shaft;

providing an oil well pumping means nonrotatably connected to said output shaft for pumping subsurface oil to the surface for containment;

providing an eddy current coupling output shaft speed sensor means for generating a speed signal;

providing a desired operating speed signal;

providing a summing junction means for generating an input control signal by adding and subtracting input signals and mathematically manipulating the result;

providing a control amplifier means for supplying electrical power to said coil means according to said input control signal;

providing a motor current sensor for generating a torque control signal representing the torque transferred by said output shaft based on said electrical power supplied to said electric drive motor and then mathematically manipulated;

subtracting said speed signal from said desired operating speed signal to generate said input control signal; and subtracting said torque control signal from said desired operating speed when said torque control signal exceeds a present level thereby limiting the maximum torque transferred by said output shaft.

18. The method of controlling an eddy current drive coupling of claim 17, further comprising:

providing a stall switching means for electrically connecting and disconnecting said control amplifier means from said coil means; and activating said stall switching means when the value of said speed signal is less than a preselected stall reference speed.

19. A method of controlling an eddy current drive coupling for use on an oil well pump comprising:

providing an AC electric drive motor;

providing an eddy current coupling comprising a driven rotatable input shaft electromagnetically rotatably coupled through an inductor member and a pole member where an electromagnetic field is generated by a coil means which travels through said inductor member and said pole member to a driving rotatable output shaft;

providing an oil well pumping means nonrotatably connected to said output shaft for pumping subsurface oil to the surface for containment;

providing an eddy current coupling output shaft speed sensor means for generating a speed signal;

providing a desired operating speed signal;

providing a summing junction means for generating an input control signal by adding and subtracting input signals and mathematically manipulating the result;

providing a control amplifier means for supplying electrical power to said coil means according to said input control signal;

providing a pump sensor means for generating an up signal and a down signal based on the direction of travel of said oil well pump;

providing a reference speed switching means for electrically connecting and disconnecting an up speed signal and a down speed signal to said summing junction means;

providing a stroke control means for controlling the state of said switching means for increasing the productivity of said oil well pump by supplying a first desired speed to said summing junction means when said oil pump is travelling upward and a second desired speed to said summing junction means when said oil pump is travelling downward; and subtracting said speed signal from said desired operating speed signal to generate said input control signal.

20. A method of controlling an eddy current drive coupling for use on an oil well pump comprising:

providing an AC electric drive motor;

providing an eddy current coupling comprising a driven rotatable input shaft electromagnetically rotatably coupled through an inductor member and a pole member where an electromagnetic field is generated by a coil means which travels through said inductor member and said pole member to a driving rotatable output shaft;

providing an oil well pumping means nonrotatably connected to said output shaft for pumping subsurface oil to the surface for containment;

providing an eddy current coupling output shaft speed sensor means for generating a speed signal;

providing a desired operating speed signal;

providing a summing junction means for generating an input control signal by adding and subtracting input signals and mathematically manipulating the result;

providing a control amplifier means for supplying electrical power to said coil means according to said input control signal;

providing a pump sensor means for generating an up signal and a down signal based on the direction of travel of said oil well pump;

providing a reference speed switching means for electrically connecting and disconnecting an up speed signal and a down speed signal to said summing junction means;

providing a stroke control means for controlling the state of said switching means for increasing the productivity of said oil well pump by supplying a first desired speed to said summing junction means when said oil pump is travelling upward and a second desired speed to said summing junction means when said oil pump is travelling downward;

providing an external speed reference signal to said stroke control means;

subtracting said speed signal from said desired operating speed signal to generate said input control signal;

opening said reference speed switching means; and connecting said external speed reference signal to said summing junction means.

* * * * *